US011773598B2

(12) United States Patent
Showalter

(10) Patent No.: US 11,773,598 B2
(45) Date of Patent: Oct. 3, 2023

(54) MEMBRANE PULLING DEVICE

(71) Applicant: Duro-Last, Inc., Saginaw, MI (US)

(72) Inventor: Brady Showalter, Spencer, IN (US)

(73) Assignee: Holcim Solutions and Products US, LLC, Nashville, TN (US)

( * ) Notice: Subject to any disclaimer, the term of this patent is extended or adjusted under 35 U.S.C. 154(b) by 668 days.

(21) Appl. No.: 16/725,137

(22) Filed: Dec. 23, 2019

(65) Prior Publication Data

US 2020/0199880 A1 Jun. 25, 2020

Related U.S. Application Data

(60) Provisional application No. 62/783,857, filed on Dec. 21, 2018.

(51) Int. Cl.

| | |
|---|---|
| ***E04D 15/04*** | (2006.01) |
| ***B65H 23/00*** | (2006.01) |
| *E04D 5/00* | (2006.01) |

(52) U.S. Cl.

CPC ..... *E04D 15/04* (2013.01); *B65H 23/00* (2013.01); *E04D 5/00* (2013.01)

(58) Field of Classification Search

CPC ..... B65H 23/00; B65H 37/005; B65H 2402/412; B65H 2701/1922; E04D 5/00; E04D 15/04

See application file for complete search history.

(56) References Cited

U.S. PATENT DOCUMENTS

| | | | | | |
|---|---|---|---|---|---|
| 334,665 | A * | 1/1886 | Jones | B66D 3/02 | 254/208 |
| 3,022,979 | A * | 2/1962 | Dahlke | A47G 27/0493 | 254/209 |
| 4,560,146 | A * | 12/1985 | Thomas | B66D 1/60 | 156/763 |
| 4,742,992 | A * | 5/1988 | Allen | B66D 3/02 | 254/212 |
| 5,348,608 | A * | 9/1994 | Glenn | A47G 27/0487 | 156/763 |
| 5,472,170 | A * | 12/1995 | Anasson | A47G 27/0493 | 254/212 |
| 5,938,182 | A * | 8/1999 | Goodrich | A47G 27/0493 | 294/8.6 |
| 6,832,751 | B2 * | 12/2004 | Shannon | A47G 27/0493 | 254/202 |
| 7,066,002 | B2 * | 6/2006 | Price | E04D 15/04 | 72/472 |
| 7,979,968 | B2 * | 7/2011 | Traska | E04D 15/04 | 254/251 |

(Continued)

*Primary Examiner* — James M Ference

(74) *Attorney, Agent, or Firm* — REISING ETHINGTON P.C.

(57) ABSTRACT

A membrane pulling device includes an elongate frame and a lever coupled with the elongate frame at a fixed position joint. The fixed position joint is positioned within a middle section of the elongate frame. A plurality of step plates are attached to the elongate frame, including a back step plate and one or more front step plates. A forward fairlead is coupled with the elongate frame and includes two pulley wheels. Side arms may pivot out from the elongate frame to assist in use of the membrane pulling device when pulling a membrane at an angle to the orientation of the device, such as adjacent to a parapet wall.

19 Claims, 3 Drawing Sheets

(56) References Cited

U.S. PATENT DOCUMENTS

| | | | | |
|---|---|---|---|---|
| 8,615,862 | B2 * | 12/2013 | Traska | B66D 3/02 254/202 |
| 9,562,357 | B1 * | 2/2017 | Harp | E04D 15/06 |
| 9,833,096 | B2 * | 12/2017 | Sorbin | A47G 27/0493 |
| 2005/0199034 | A1 * | 9/2005 | Price | B21D 22/04 72/450 |
| 2006/0070223 | A1 * | 4/2006 | Traska | E04D 15/04 29/244 |
| 2008/0217593 | A1 * | 9/2008 | Kirker | A47G 27/0493 254/200 |
| 2012/0211708 | A1 * | 8/2012 | Traska | B66D 3/02 254/131 |
| 2020/0199880 | A1 * | 6/2020 | Showalter | B65H 23/00 |

* cited by examiner

MEMBRANE PULLING DEVICE

CROSS-REFERENCE TO RELATED APPLICATIONS

This patent application claims priority to U.S. Provisional Patent Application Ser. No. 62/783,857, filed on Dec. 21, 2018, the contents of which are incorporated herein by reference.

TECHNICAL FIELD

The present disclosure relates generally to roof installation and, more particularly, to systems, devices, and methodology for installing a weather-resistant roofing membrane.

BACKGROUND

Modern roofing strategies typically include applying one or more layers of weather resistant materials to protect underlying structures from the damaging effects of water and moisture. In a common implementation strategy, a weather resistant layer is formed from a membrane-like sheet of roofing material that must be stretched over roofing surfaces prior to installation. Such membranes are typically formed of relatively thin, flexible, yet durable materials and are often packaged in large rolls or sheets to facilitate installation. While installation of this type of membranous layer is generally quite effective in protecting against unwanted moisture and weather, the installation process can be challenging. For example, as mentioned above, the sheets are typically fairly large, heavy, and can be difficult to manage. Compounding matters further, these sheets must be pulled taut prior to installation, as folds, creases, or wrinkles may adversely impact their effectiveness.

A number of strategies have been developed to facilitate in the installation of such membrane layers. One such strategy is disclosed in U.S. Pat. No. 8,615,862 to Traska ("Traska"). Traska discloses a membrane puller and related method. The puller device includes a lever and a clamp structured to grip the roofing membrane. More specifically, the clamp includes a mechanism that apparently allows a user to engage the clamp by lifting a lever using his or her foot. The user can then actuate the lever to pull the membrane tight during installation. While this and other strategies may be effective in assisting roofing membrane installation in certain situations, there remains ample room for improvement.

SUMMARY OF THE INVENTION

In one aspect, a membrane pulling device includes an elongate frame having a first section, a second section, and a middle section extending between the first section and the second section. The device also includes a lever, a pivot coupling connecting the lever to the elongate frame within the middle section, and a fairlead extending from the second end of the elongate frame. A pulley assembly is coupled to the first section of the elongate frame, and includes a cable that has a first end coupled to the lever, and that extends through the pulley assembly and the fairlead to a second end structured to attach to a membrane clamp. The device further includes a plurality of step plates attached to the elongate frame.

DETAILED DESCRIPTION

Figure 1:
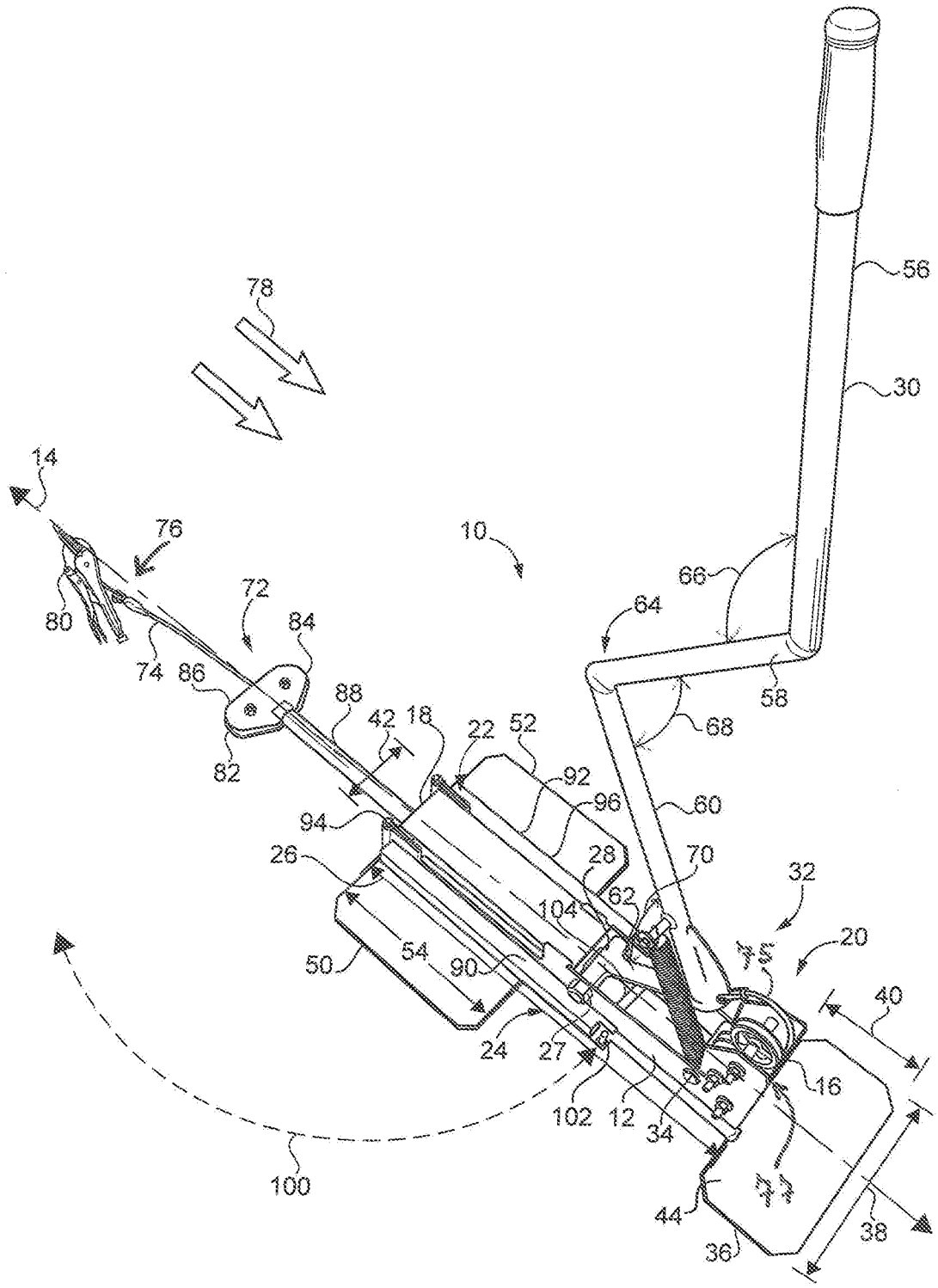
FIG. 1 is a diagrammatic view of a membrane pulling device, according to a first embodiment.

Referring to FIG. 1 a membrane pulling device ("device") 10 is shown. Device 10 may be structured to facilitate pulling a membrane taut for installation upon a substrate, such as a building roof. Device 10 includes an elongate frame 12 defining a longitudinal axis 14 extending from a first end 16 of elongate frame 12 to a second end 18 of elongate frame 12. In the orientation shown in FIG. 1 first end 16 may be a back end (hereinafter "back end 16") of device 10, and second end 18 may be a front end (hereinafter "front end 18") of device 10. The terms "front," "back," and "middle", "upper" and "lower," and "right" and "left," and like terms are used herein in a relative sense, each in relation to each other, and are not intended as limiting. Additionally, the terms "width" and "length" are also used in a relative sense, each describing the general direction of a dimension relative to longitudinal axis 14, and should not be interpreted to mean device 10 or any components thereof has a particular shape. For instance, a "width dimension" should be understood to mean a maximum dimension of a component in a direction transverse to longitudinal axis 14, and a "length dimension" should be understood to mean a maximum dimension of a component in a direction substantially parallel to longitudinal axis 14.

Elongate frame 12 may include a first or back section ("back section") 20 adjacent to back end 16, a second or front section ("front section") 22 adjacent to front end 18, and a middle section 24 extending between front section 22 and back section 20. Each section 20, 22, 24 may extend approximately one-third a length dimension 26 of elongate frame 12 between front end 18 and back end 16, with middle section 24 including a geometric center of device 10, which may also correspond approximately with a center of gravity of device 10. Lever 30 may be coupled to elongate frame 12 within middle section 24 by a fastener 27, such as a bolt, pin, or a screw, to form a pivot coupling or pivoting joint ("joint") 28. Joint 28 may be a fixed position joint that pivotally couples lever 30 with elongate frame 12 such that lever 30 can be moved between a neutral, generally vertical orientation or position (a "rearward position"), and a forward orientation or position (a "forward position"). Device 10 may further include a pivoting mechanism 32 structured to facilitate movement of lever 30 relative to elongate frame 12. Pivoting mechanism 32 may include joint 28, lever 30, and a return spring ("spring") 34 extending between lever 30 and back section 20 of elongate frame 12 and structured to elongate in response to pivoting lever 30 forward. Spring 34 can be, for instance, a coil spring, a gas spring, or the like, and may be structured to tension pivoting mechanism 32 such that lever 30 is biased towards the rearward position. In other embodiments, pivoting mechanism 32 may not include spring 34, or might include additional or alternative structures for controlling or influencing movement of lever 30. Pivoting mechanism 32 may be structured to permit lever 30 to pivot relative to elongate frame 12 around an axis of rotation defined by joint 28 and fixed at a location at or near the center of gravity of device 10. As will be appreciated by those skilled in the art, positioning joint 28 at or near the center of gravity of device 10 may, amongst other things, allow a user to more easily use lever 30 to lift and/or carry device 10 during use as compared to a device in which a lever is coupled with a frame further away from the center of gravity of the device. The angular shape of lever 30 also assists in this functionality.

Device 10 further includes a plurality of substantially planar step plates structured to allow a user to step thereon in a manner that allows the user to leverage his or her bodyweight to anchor device 10 on a work surface during use. The plurality of step plates includes a back step plate ("back plate") 36 that may have an upper surface 44 and a lower surface opposite upper surface 44, each having a relatively large surface area, especially as compared to analogous structures in known membrane pulling devices. It has been observed that providing step plates with a relatively large surface area may be better suited to engage and/or grip work surfaces to prevent device 10 from slipping or moving during use without causing or risking damage to the work surface through use of surface puncturing spikes, claws, anchors, or other surface-penetrating protrusions. To this end, back plate 36 may have a width dimension 38 and a length dimension 40 structured such that upper surface 44 may be able to accommodate a user's entire foot/shoe. In an embodiment, back plate 36 may be structured such that width dimension 38 is greater than a width dimension 42 of elongate frame 12. More specifically, width dimension 38 might be at least 50% greater than width dimension 42, although embodiments in which width dimension 38 has a fixed value or range of values independent of width dimension 42 are also contemplated. For instance, width dimension 38 may be about 6 inches or greater or, more particularly, from about 10 inches to about 14 inches. As used herein, the term "about" can be understood to mean generally, or approximately, for example, in the context of conventional rounding to a consistent number of significant digits. For example, "about 6 inches" might mean from 5.5 inches to 6.4 inches, "about 10 inches" from 9.5 inches to 10.4 inches, and so on.

Back plate 36 can be attached to and extend rearwardly from back section 20 so as to have a substantially orthogonal orientation relative to longitudinal axis 14. In other embodiments, back plate 36 may have a different shape and/or structure than that shown in FIG. 1. For instance, in other embodiments, back plate 36 may have a different polygonal shape, or may be circular or oblong. Both upper surface 44 and the lower surface of back plate 36 may be substantially planar and substantially free of projections that may penetrate the work surface, although the present disclosure is not thusly limited and teeth or other protrusions might be used. Back plate 36 may include a slip-resistant material attached to or otherwise coupled with upper surface 44 and/or the lower surface. For example, in an embodiment, back plate 36 may include an engagement surface (not shown) structured to prevent device 10 from sliding or moving on the work surface during operation when contacting a work surface. The engagement surface might be integral with the lower surface of back plate 36. For instance, the engagement surface could be formed by texturing the lower surface of back plate 36 by way of scoring, knurling, brushing, or any other suitable texturing technique. In one practical implementation strategy, rubber or rubber-like pads can be attached to back plate 36, and the other plates discussed hereinafter. Such pads can advantageously assist in cushioning device 10 upon a work surface, such as a newly laid membrane.

Device 10 can also include one or more front step plates positioned at or within front section 22. In an embodiment, device 10 includes a first front step plate 50 and a second front step plate 52 that are each attached to sides of elongate frame 12 that are on either side of longitudinal axis 14. Put differently, in the orientation of device 10 shown in FIG. 1, first front step plate 50 may be a left front step plate and second front step plate 52 may be a right front step plate. Front step plates 50, 52 may have a similar or even an identical structure to back plate 36, although front step plates 50, 52 might be oriented parallel to longitudinal axis 14. Front step plates 50, 52 will typically have a similar, or even identical structure, although the present disclosure is not thusly limited. Like back plate 36, front step plates 50, 52 may have relatively large surface areas structured to allow users to step thereon to leverage their body weight to prevent undesired movement of device 10 during use. For example, one or both of front step plates 50, 52 may have a length dimension 54 at least ⅓ of length dimension 26 of elongate frame 12. In some embodiments, length dimension 54 may have a fixed value or range of values independent of length dimension 26, however. For instance, in an embodiment, length dimension 54 may be about 6 inches or greater. Step plates 50 and 52 could be parts of a single plate in some embodiments.

As can be seen, the position and structure of step plates 36, 50, 52 may be such that a user may be able to anchor device 10 to a work surface by placing one foot on back plate 36 and the other on one of front step plates 50, 52 such that joint 28 is positioned between the user's feet. In other words, the center of gravity of device 10 may be in general horizontal alignment with the user's center of gravity. It will be appreciated that this relative positioning may allow users to more effectively leverage their body weight to move lever 30 towards the forward position than a device in which one or more axes of rotation are positioned away from the user's center of gravity. When operating device 10, movement of lever 30 from the rearward position to the forward position can allow the user to first pull or push lever 30 just slightly towards his or her center of gravity, and then push lever 30 away from his or her center of gravity, and downward. Aligning the center of gravity of device and of the user may not only allow users to better leverage their body weight to operate device 10 but may also allow the user to better maintain his or her balance during operation.

Lever 30 may also be specially structured to assist in or otherwise facilitate operation of device 10. Lever 30 may include a first or free end segment ("free end segment") 56, a second segment 58, a third segment 60, and a fourth or pivot segment ("pivot segment") 62 that is coupled with elongate frame 12 to form joint 28. Each segment 56, 58, 30, 62 may be angled to adjacent sections such that lever 30 has a non-linear shape, such as a zig-zag shape, depending upon perspective. Free end segment 56 and second segment 58 may form a first angle 66, second segment 58 and third segment 60 may form a second angle 68, and third segment 60 and pivot segment 62 may form a third angle 70. In the embodiment shown in FIG. 1, first angle 66 may be greater than second angle 68, and second angle 68 may be greater than third angle 70. More specifically, third angle 70 might be about 90 degrees, or less, second angle 68 might be greater than 90 degrees, and first angle 66 might be greater still. In this way, in the rearward position, free end segment 56 can be generally aligned with or may at least approach a vertical plane or direction defined by back end 16 and normal to the back plate. Such a construction might allow lever 30 to be moved between the rearward and forward positions without the user's leg or torso obstructing such movement. In other embodiments, lever 30 might have a different shape, however. For example, lever 30 may have a curved, rather than angular, geometry, or may include more or fewer segments.

Pivot segment 62 may form an acute angle with elongate frame 12 when lever 30 is in the rearward position. In contrast to known membrane pulling devices that include a pivot point in the back section of the device and a lever or lever coupling member that points forward from the device frame, in the rearward (i.e., neutral) position, pivot segment 62 extends rearward from joint 28 defining a fixed pivot point (also called a fixed pivot axis). Spring 34, or multiple springs, may be attached to lever 30 such that spring 34 elongates to oppose movement of lever 30 towards the forward position. In other instances, a spring could extend forward from lever 30 and be compressed in opposition to forward moving of lever 30. Lever 30 might also contact a hard physical stop, such as a surface on elongate frame 12, or a surface upon a flange or protrusion or the like upon elongate frame 12, and having a fixed location upon or relative to elongate frame 12 at the rearward position. In the illustrated embodiment, pivot segment 62 contacts a dead stop 104 at the rearward position of lever 30, approximately as shown in FIG. 1. Further, device 10 is structured to operate more efficiently than known devices that include a link arm or analogous structure forming a second pivot point at a roller slide or similar sliding mechanism. Specifically, device 10 includes a single pivot point at joint 28 such that lever 30 pivots close to the center of gravity of device 10 during operation.

Device 10 further includes a pulley assembly 72 that includes a plurality of pulley wheels and a cable 74 having a first end 75 coupled with lever 30. Cable 74 may extend through a cable guide 77, including a pulley for example, and through pulley assembly 72 to a second or free end ("free end") 76 structured to attach to a membrane clamp 80 structured to grasp and hold a membrane for pulling. The membrane might include protruding tabs between welded-together sections to which clamp 80 is secured, for example. Pulley assembly 72 is structured to translate movement of lever 30 to cable 74 such that moving lever 30 from the rearward position towards a forward position can pull free end 76 towards elongate frame 12 in a pulling direction 78. The plurality of pulley wheels includes a first forward pulley 82 and a second forward pulley 84 that are positioned forward of front end 18 and laterally adjacent to each other. A forward fairlead 86 structured to receive and guide movement of cable 74 may house forward pullies 82, 84. Forward fairlead 86 may include an arm or tube section 88 extending forward from elongate frame 12, with each forward pulley 82, 84 being positioned on opposite sides thereof. Cable 74 may be fed through tube section 88. In the orientation of FIG. 1, first forward pulley 82 may be positioned on a left side of tube section 88 (hereinafter "left pulley 82"), and second forward pulley 84 may be positioned on a right side of tube section 88 (hereinafter "right pulley 84").

In addition to pulling membrane straight back generally in a direction opposite to forward pivoting of lever 30, forward fairlead 86 may allow device 10 to be positioned such that longitudinal axis 14 is angled, left or right, to pulling direction 78. For instance, device 10 can be angled away from, but less than 180 degrees from, pulling direction 78. When device 10 is angled to pulling direction 78, cable 74 can feed through either left pulley 82 or right pulley 84. In this way, device 10 can have a wider range of orientations relative to a membrane than known membrane pulling devices. For example, many such devices are structured in a manner that allows them to pull only, or efficiently only, in a direction that is substantially parallel with the device's pulling direction. In other words, such devices must be oriented close to parallel to the pulling direction, and if transverse pulling is attempted the device has a tendency to be rotated, hence the common use of surface-penetrating teeth or the like in such devices.

Device 10 may further include a first or left leverage arm ("left arm") 90 and a second or right leverage arm ("right arm") 92 pivotally coupled with elongate frame 12 on opposite sides by pivotable joints ("joints") 94. Joints 94 may be positioned within front section 22 near or adjacent to front end 18 such that each arm 90, 92 can pivot about 180 degrees relative to longitudinal axis 14. Each arm 90, 92 may be structured to connect to clamp 80 so as to support cable 74 in a manner that may assist in using device 10 at transverse angles relative to pulling direction 78. Device 10 might be used in such a manner to pull cable 74 in a path that forms an angle of about 90 degrees or greater to the pulling direction. In other words, cable 74 might be nearly doubled back relative to the pulling direction. A pin 102 on the free end of arm 90, 92 can engage with an eye, such as a welded eyelet, or a bore, in or on clamp 80, and thereby utilize the swing of arm 90 or 92 to assist in pulling the membrane in the desired direction. A dashed arc 100 in FIG. 1 shows on the approximate swing path of arm 90. This general capability is particularly advantageous when stretching a membrane toward a parapet wall or other obstruction on a building roof Device 10 can also be aligned generally along a parapet wall or other obstruction, within a range of angles to the parapet wall, and used to pull a membrane both toward and along the obstruction at the same time. Flashing may also be pulled tout along a parapet wall, curb, or other obstruction, with device 10 being placed upon new membrane that has been positioned next to the parapet wall, etc. The use of pads or the like on plates 36 and 80 enables device 10 to be positioned on new membrane without risk of puncture or damage as might be caused by teeth, pegs, or other features. Each arm 90, 92 might include a slot, a hole, a hook, clamp, a pin, or any other suitable structure for connecting to clamp 80 and/or cable 74. When arms 90 and 92 are used, arms 90 and 92 will pivot about the respective joint 94 as the membrane is pulled taut. In another embodiment, arms 90,92 could be removably coupled with device 10. For instance, arms 90,92 could be mounted to a slip-on, bolt on attachment or other assembly coupled with elongate frame 12. In other embodiments, an assembly including side arms 90,92 might be structured to fit upon a different type of membrane pulling device as an aftermarket product or an optional add-on.

Figure 2:
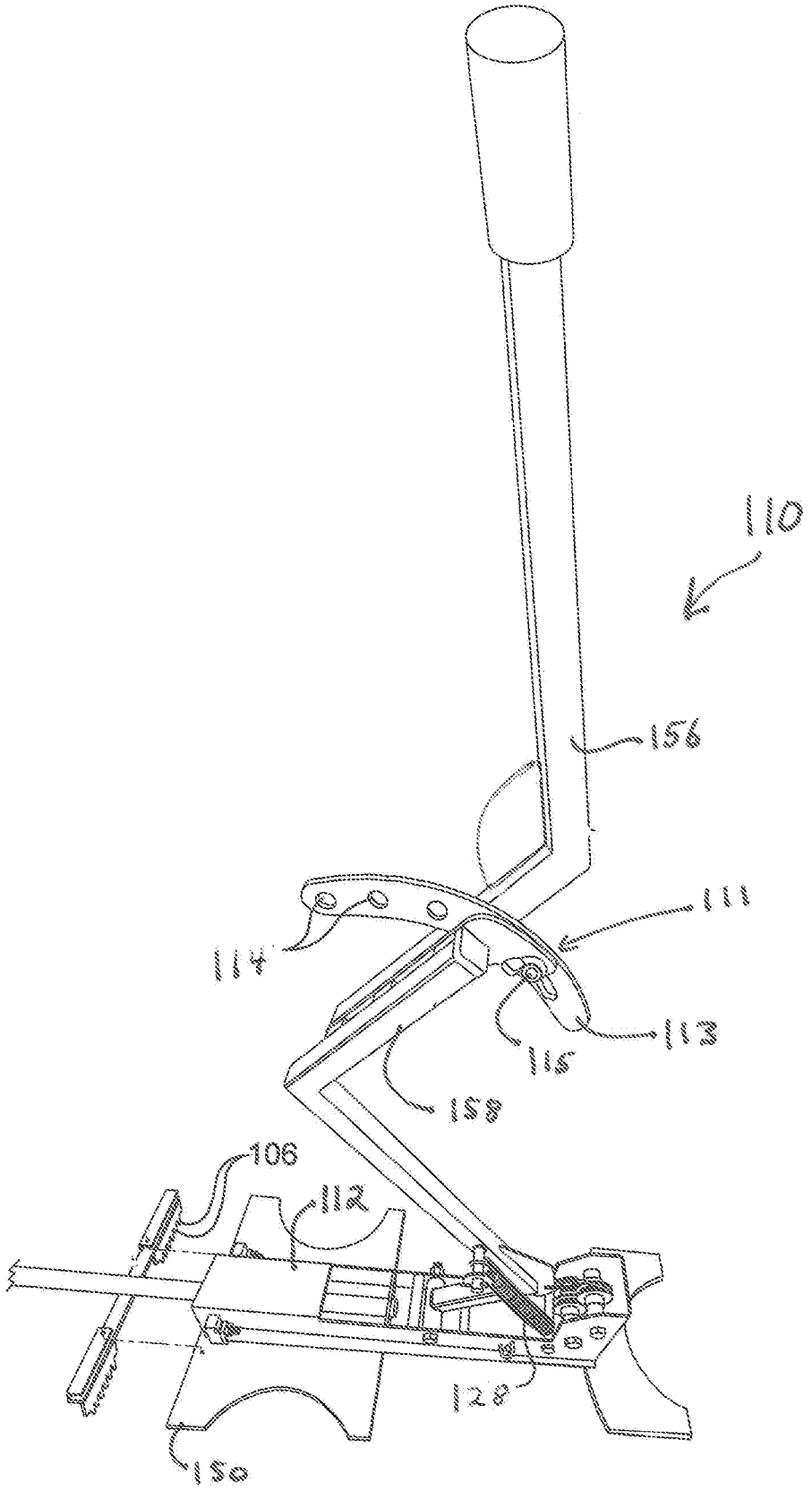
FIG. 2 is a diagrammatic view of a membrane pulling device, according to a second embodiment.
Figure 3:
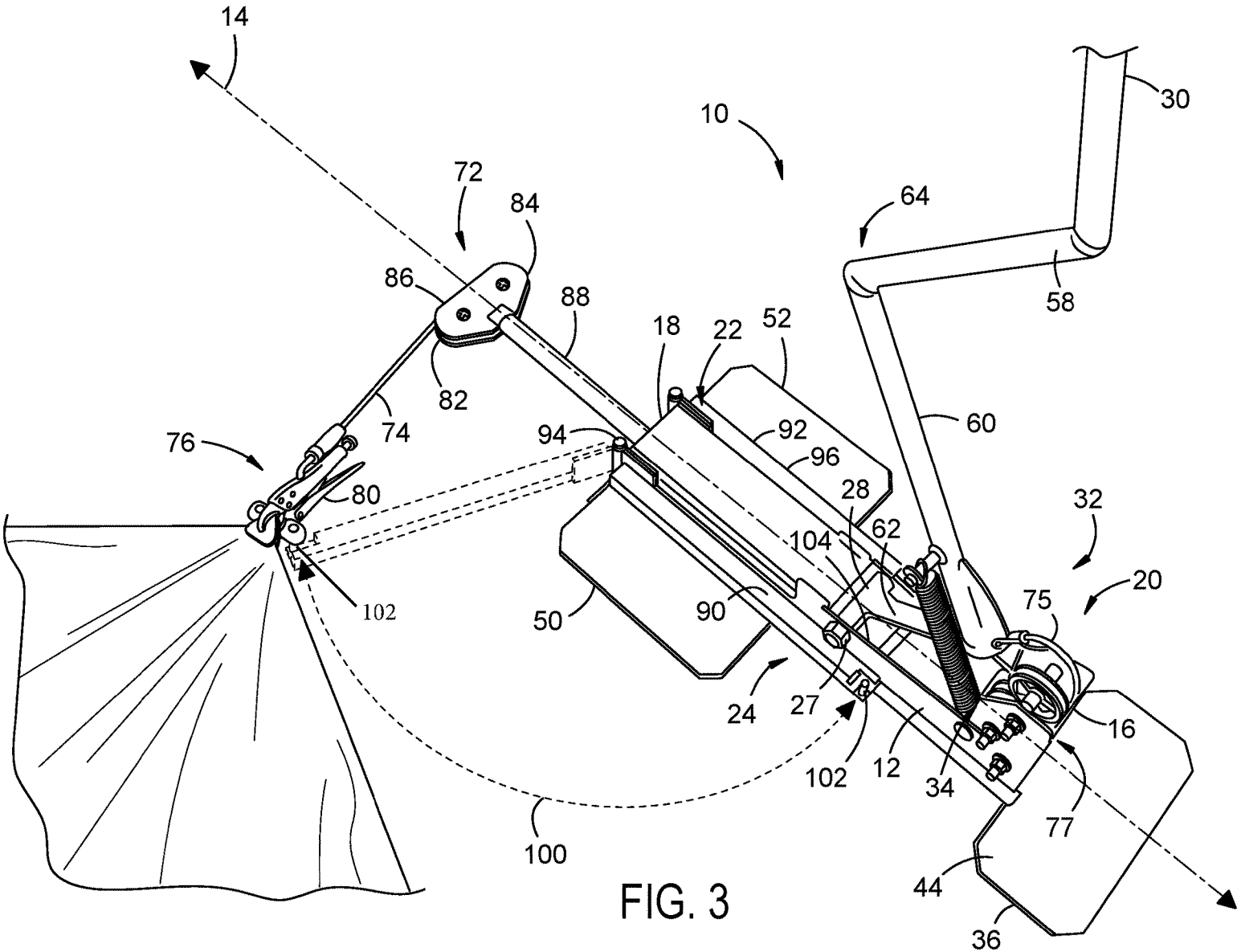
FIG. 3 is a diagrammatic view of a membrane pulling device, according to a first embodiment.

In some embodiments, as illustrated in FIG. 2, an elongate frame 112 of a membrane pulling device 110 is coupled with teeth or like engagement members 106 for engaging or gripping a surface. Such teeth 106 may extend from one or more frame portions of elongate frame 112 at any location, from step plates, from a fairlead, and/or from a separate gripping portion attached to frame 112 or step plates, etc. In the illustrated embodiments, teeth 106 can be mounted at a forward end of a step plate 150 attached to frame 112. In some embodiments, the lever includes at least one adjustable joint 111 operationally connected between two portions, such as first and second lever segments 156, 158. In this example, adjustable joint 111 includes a curved plate 113 and a plurality of apertures 114 through which a pin 115 may extend to connect segments 156, 158. Adjustable joint 111 is fixedly connected to one segment 156,158 but not the other segment 156, 158, allowing the angular relationship between segments 156, 158 to be varied. A pivot joint 128 of device 110 may be substantially identical to the preceding embodiment, as may other features of device 110, including pulleys, swing-out arms, a fairlead, clamps, etc., although not all are shown in FIG. 2.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A membrane pulling device comprising:

an elongate frame having a first section, a second section, and a middle section extending between the first section and the second section, the elongate frame further including a first end of the elongate frame and a second end of the elongate frame;

a lever;

a pivot coupling connecting the lever to the elongate frame within the middle section;

a fairlead extending from the second end of the elongate frame;

a pulley assembly coupled to the first section of the elongate frame, and including a cable having a first end coupled to the lever, and that extends through the pulley assembly and the fairlead to a second end structured to attach to a membrane clamp;

at least one side arm coupled with the elongate frame by at least one pivotable joint and configured to pivot laterally outwardly from the elongate frame; and at least one step plate attached to the elongate frame, wherein the step plate is planar and has an upper surface and a lower surface, the lower surface being configured to be placed on a work surface.

2. The membrane pulling device of claim 1 wherein the lever has an angular shape.

3. The membrane pulling device of claim 1 wherein the lever has a pivot segment coupled to the elongate frame at the pivot coupling, and a forward projecting segment extending forwardly and vertically upwardly from the pivot segment when the lever is oriented so as to extend generally vertically upward from the elongate frame.

4. The membrane pulling device of claim 1 wherein the at least one side arm comprises a first side arm and a second side arm and wherein the at least one pivotable joint comprises a first pivotable joint and a second pivotable joint.

5. The membrane pulling device of claim 1 wherein the fairlead includes two pulleys.

6. The membrane pulling device of claim 1 further including a return spring extending between the lever and the elongate frame and structured to elongate or shorten in response to pivoting the lever in forward direction toward the second end of the elongate frame.

7. The membrane pulling device of claim 1 wherein the at least one step plate further comprises a plurality of step plates including a back step plate attached to the first section of the elongate frame, and a front step plate attached to the second section of the elongate frame.

8. The membrane pulling device of claim 4 wherein the elongate frame defines a longitudinal axis; the cable is operationally connected to a membrane; and wherein actuation of the lever exerts a pulling force on the membrane parallel to the longitudinal axis of the frame.

9. The membrane pulling device of claim 4 wherein the frame defines a longitudinal axis; the cable is operationally connected to a membrane; and wherein actuation of the lever exerts a pulling force on the membrane transverse to the longitudinal axis of the frame.

10. A membrane pulling assembly, comprising:

an elongate frame defining a longitudinal axis and having a first section, a second section, and a middle section extending between the first section and the second section, the elongate frame further including a first end of the elongate frame and a second end of the elongate frame;

an elongate angular lever arm;

a pivot coupling defining a fixed pivot axis and connecting the elongate lever arm to the middle section;

a fairlead extending from the second end of the elongate frame;

a cable guide coupled to the first section of the elongate frame for receiving a cable having a first end connectible to the lever and extendable through the cable guide and in cooperation with the fairlead to attach to a membrane clamp; and at least one side arm pivotably coupled to the elongate frame to allow the side arm to pivot transversely to the longitudinal axis and outwardly from the elongate frame and configured to couple with the membrane clamp.

11. The membrane pulling assembly of claim 10 and further comprising a membrane clamp and a cable extending through the cable guide and connecting the lever to the membrane clamp.

12. The membrane pulling assembly of claim 10 wherein the cable guide includes a first pulley coupled to the elongate frame.

13. The membrane pulling assembly of claim 10 wherein the at least one side arm comprises a first side arm and a second side arm coupled with the elongate frame by a first pivotable joint and a second pivotable joint, respectively.

14. The membrane pulling device of claim 10 wherein the fairlead includes first and second pulleys.

15. The membrane pulling device of claim 10 wherein the elongate angular lever arm defines and adjustable angle.

16. A membrane tightening device, comprising:

an elongate frame having a first section, a second section, and a middle section extending between the first section and the second section and defining a longitudinal axis, the elongate frame further including a first end of the elongate frame and a second end of the elongate frame;

a lever;

a fixed pivot coupling connecting the lever to the elongate frame within the middle section;

a fairlead extending from the second end of the elongate frame;

a pulley assembly coupled to the first section of the elongate frame;

a first side arm pivotably coupled to the elongate and a second, oppositely disposed side arm pivotably coupled to the elongate frame;

a cable operationally connected to the pulley assembly, to at least one of the first or the second side arms, and to the fairlead, wherein the cable operationally connects the lever to a membrane clamp; and a plurality of step plates attached to the elongate frame.

17. The membrane tightening device of claim 16 wherein the membrane clamp is operationally connected to a membrane; and wherein actuation of the lever pulls the membrane in a direction parallel to the longitudinal axis.

18. The membrane tightening device of claim 16 wherein the membrane clamp is operationally connected to a membrane; and wherein actuation of the lever pulls the membrane in a direction perpendicular to the longitudinal axis.

19. The membrane tightening device of claim 16 wherein the lever is adjustable angularly and wherein a plurality of gripping teeth are operationally connected to the frame.

* * * * *